US011457681B2

(12) United States Patent
Shriver

(10) Patent No.: US 11,457,681 B2
(45) Date of Patent: Oct. 4, 2022

(54) METHOD FOR APPLYING RESISTANCE THROUGH EXERCISE CLOTHING

(71) Applicant: Shriver Enterprises LLC, Marlborough, CT (US)

(72) Inventor: Mccullough Shriver, Marlborough, CT (US)

(73) Assignee: Shriver Enterprises, LLC, Marlborough, CT (US)

( * ) Notice: Subject to any disclaimer, the term of this patent is extended or adjusted under 35 U.S.C. 154(b) by 338 days.

(21) Appl. No.: 16/541,470

(22) Filed: Aug. 15, 2019

(65) Prior Publication Data

US 2019/0364987 A1 Dec. 5, 2019

Related U.S. Application Data

(62) Division of application No. 14/983,148, filed on Dec. 29, 2015, now abandoned.

(60) Provisional application No. 62/097,233, filed on Dec. 29, 2014.

(51) Int. Cl.

| | |
|---|---|
| ***A41D 31/18*** | (2019.01) |
| ***A41D 13/00*** | (2006.01) |
| ***A63B 21/055*** | (2006.01) |
| ***A63B 21/04*** | (2006.01) |

(52) U.S. Cl.

CPC ..... *A41D 31/18* (2019.02); *A41D 13/0015* (2013.01); *A41D 31/185* (2019.02); *A63B 21/04* (2013.01); *A63B 21/0552* (2013.01); *A41D 2300/22* (2013.01)

(58) Field of Classification Search

CPC ..... A61F 5/026; A41D 13/0015; A41D 31/18

See application file for complete search history.

(56) References Cited

U.S. PATENT DOCUMENTS

| | | | | |
|---|---|---|---|---|
| 3,116,735 | A * | 1/1964 | Geimer | A61F 5/026 450/2 |
| 4,065,814 | A | 1/1978 | Fox | |
| 5,201,074 | A * | 4/1993 | Dicker | A63B 21/0552 2/70 |
| 5,367,708 | A * | 11/1994 | Fujimoto | A41D 31/18 2/22 |
| 5,570,472 | A | 11/1996 | Dicker | |
| 8,347,412 | B2 | 1/2013 | Clement | |
| 2007/0028362 | A1 | 2/2007 | Cash | |
| 2008/0256675 | A1 | 10/2008 | Di Lorenzo | |

(Continued)

OTHER PUBLICATIONS

PCT International Search Report dated Jun. 30, 2016, in international patent application No. PCT/US2015/067904.

*Primary Examiner* — Katherine M Moran

(74) *Attorney, Agent, or Firm* — McCarter & English, LLP

(57) ABSTRACT

A method and apparatus for exercising a muscle in a given agonist and antagonist muscle pair of a user's human body by providing an elongated elastic band having a first length when no external forces are applied thereto, elongating the elastic band to a second length that is greater than the first length, securing the elastic band to a garment in a manner whereby when the elastic band is installed on the garment an axial force is imposed on the body of the user and the elastic band is disposed in aligned proximate relationship with at least one of the muscles in a given pair of muscles comprising an agonist muscle and antagonist muscle pair.

6 Claims, 13 Drawing Sheets

(56) References Cited

U.S. PATENT DOCUMENTS

| | | | | |
|---|---|---|---|---|
| 2010/0050313 | A1* | 3/2010 | Shackelford, Jr. | A41D 13/1245 2/69 |
| 2013/0190147 | A1 | 7/2013 | Luo et al. | |
| 2014/0336556 | A1* | 11/2014 | Pucik | A61F 5/026 602/19 |

* cited by examiner

METHOD FOR APPLYING RESISTANCE THROUGH EXERCISE CLOTHING

CROSS-REFERENCE TO RELATED APPLICATIONS

The present application is a divisional application claiming priority benefit to a co-pending US non-provisional application entitled "Resistance Exercise Clothing," which was filed on Dec. 29, 2015, and assigned Ser. No. 14/983,148, and which claimed priority to U.S. provisional application Ser. No. 62/097,233, filed on Dec. 29, 2014.

TECHNICAL FIELD

The present invention is generally directed to clothing. More particularly, the present invention is directed to clothing that is intended to exercise specific muscle or muscles of the human body. Other embodiments may be relevant to other animals and the exercise thereof.

BACKGROUND OF THE INVENTION

The human body is made up of hundreds of muscles; each classified as either skeletal, visceral or cardiac muscle tissue. Both flexors and extensors are skeletal muscles, and both have a unique function in the body relating to joint movement. Skeletal muscles attached to a bone, interact with bones for movement and are voluntarily controlled. When performing a workout, we activate the body's skeletal muscle groups to create movement and burn calories. Flexors and extensors are at the core of such movement. Together, they bend and straighten the body's joints to create motion and activate other muscle groups. Flexors work to bend a joint. You may recognize a common exercise term right in the word "flex." When you flex your muscles, your flexors contract and pull on the bone, creating a bending movement of the joint. When making a bicep curl a person pulls his or her fist upward to his or her shoulder. The angle between the forearm and bicep decreases as the flexor muscle tightens and contracts. Extensors serve the opposite purpose. They increase the angle between, for example, the upper and lower arm. In a bicep curl, the extensor muscles contract as the fist is let down from the shoulder. The same occurs with walking or running, as hip extensors contract and pull the thigh back to the original straightened position.

Agonist muscles and antagonist muscles refer to muscles that cause or inhibit a movement. Agonist muscles cause a movement to occur through their own contraction. For example, the triceps brachii does during the up phase of a push-up (elbow extension). During the down phase of a push-up, the same triceps brachii actively controls elbow flexion while relaxing. It is still the agonist. While resisting gravity during relaxing, the triceps brachii is still the prime mover, or controller, of the joint action. For both of those movements the elbow flexor muscles are the antagonists. Agonists are also referred to, interchangeably, as "prime movers", since they are the muscles being considered that are primarily responsible for generating a specific movement. This term typically describes skeletal muscles.

Antagonist muscles oppose a specific movement. This controls a motion, slows it down, and returns a limb to its initial position. Antagonism is not an intrinsic property. It is a role, played depending on the motion. If the motion is reversed, agonist and antagonist switch roles. While a flexor muscle is always flexor when acting in flexion, it is agonist, and when acting in extension, it is antagonist. An extensor muscle is agonist in extension and antagonist in flexion.

The present concept will be better understood by contrasting other prior art apparatus:

US Patent application 20080256675 shows panels compressing the vastus lateralis muscle. This compression is inconsistent with the present invention. Thus, this document is representative of art that does not teach the present invention. The reference to this document is merely to differentiate a common garment construction that does not show or suggest the present approach.

U.S. Pat. No. 8,347,412 describes athletic pants that comprise a main body portion comprised of a first material. The main body portion includes a hip portion, a first leg extending from the hip portion and a second leg extending from the hip portion. At least one opening is formed in the main body with a second material provided in the opening. The second material is different from the first material and has a substantially greater elasticity than the first material. The opening may be provided as a horizontal slit in a knee portion of the main body. Alternatively or in addition, the opening may be provided as a vertical slit extending along a vastus lateralis portion of the pants. Thus less elastic force over the knee joint is inconsistent with the apparatus of the present invention.

US Patent application 20070028362 teaches apertured clothing in which the opening is over the vastus lateralis.

A wide variety of so called exercise clothing includes compression garments that do not provide, supplement or improve muscle exercise. The prior art described above also do not achieve material benefits. Clothing capable of achieving such benefits has enormous potential benefits. It is therefore seen that there exists a need in the art to overcome the deficiencies and limitations described herein and above.

SUMMARY OF THE INVENTION

The shortcomings of the prior art are overcome and additional advantages are provided through elongated elastic members that are part of garment. Each such member is disposed in aligned proximate relationship with at least one of the muscles in a given pair of muscles comprising an agonist muscle and antagonist muscle.

In another aspect such elongated elastic members are disposed in aligned proximate relationship with respect to both of the muscles in a given pair of muscles comprising an agonist muscle and antagonist muscle.

The present invention includes the method for exercising a muscle in a given agonist and antagonist muscle pair of a user's human body by providing an elongated elastic band having a first length when no external forces are applied thereto, elongating the elastic band to a second length that is greater than the first length, securing the elastic band to a garment in a manner whereby when the elastic band is installed on the garment an axial force is imposed on the body of the user and each such elastic band is disposed in aligned proximate relationship with at least one of the muscles in a given pair of muscles comprising an agonist muscle and antagonist muscle.

In some embodiments the method includes positioning elastic members in aligned proximate relationship with respect to both of the muscles in a given pair of muscles comprising an agonist muscle and antagonist muscle. The method may include the step of attaching an elongated elastic member to a garment in a manner whereby when the garment is installed an axial force is imposed on the body of the user with each such member disposed in aligned proximate relationship with at least one of the muscles in a given pair of muscles comprising an agonist muscle and antagonist muscle includes attaching a first elastic band having a first end disposed at one of the insertion paths of the muscles at both the intertubercular groove (sulcus) and the crest of the greater tubercle.

The method may include attaching first and second elastic bands having respective first ends disposed at left and right insertion paths of the muscles at both the intertubercular groove (sulcus) and the crest of the greater tubercle. Other embodiments of the method wherein the step of attaching includes positioning the first and second elastic bands to extend downwardly generally aligned with the infraspinatus muscle. The method may include the step of attaching that includes attaching each of the second ends of the elastic bands across the back of the shirt to the side thereof distal from the first end thereof.

Other forms of the invention include a garment for use by a human having an elongated elastic member fabricated into the garment, which is in tension when the garment is worn by the user and disposed in aligned proximate relationship with at least one of the muscles in a given pair of muscles comprising an agonist muscle and antagonist muscle. The garment may exercise an agonist muscle in a given pair of muscles is achieved by imposing a force on the body of the person wearing the garment that simulates the force and direction that would be produced by the antagonistic muscle if the antagonist muscle was contracted. The garment may have an elongated elastic member disposed in aligned proximate relation with respect to the antagonistic muscle in the pair of muscles on a garment worn by the user whereby the agonist muscle has to work harder to overcome the forces imposed by the elongated elastic member and improved exercise of the agonist muscle is achieved.

Some embodiments of the garment in accordance with the present invention have at least (a) one elongated elastic band having first and second axial spaced points of the equilibrium length of the elastic band fixed to (b) first and second axial spaced points of the garment without the application of external forces and the first and second points on the elastic band are closer together than the first and second points on the garment without the application of external forces and said first and second points on said elastic band and said first and second points on said garment are dimensioned and configured to be aligned with a specific muscle.

The garment may have the first and second points on the elastic band and the first and second points on said garment are dimensioned and configured to align with an antagonist muscle. The garment may include a first elastic band having a first end disposed at one of the insertion paths of the muscles at both the intertubercular groove (sulcus) and the crest of the greater tubercle.

The garment may include first and second elastic bands each having a first end disposed at both left and right insertion paths of the muscles at an intertubercular groove (sulcus) and the crest of the greater tubercle. The garment have first and second elastic bands that extend downwardly from said first end and are generally aligned with the infraspinatus muscle when the garment is worn. Each of the second ends of the elastic bands may extend across the back of the shirt to the side thereof distal from the first end thereof.

It is an object of the present invention to enhance exercises, assist in rehabilitation of the body, and improve posture.

It is an object of the present invention to engage a particular muscles by providing clothing that provides an external force opposing the particular muscle.

It is yet another object of the present invention to provide an apparatus and method that have targeted muscles contract eccentrically (the muscle elongates while under tension from an opposing force greater than the muscle produces).

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The foregoing and other objects, features and advantages of the invention will be apparent from the following more particular description of illustrative embodiments of the invention, as illustrated in the accompanying drawings in which like reference characters refer to the same parts throughout the different views. The drawings are not necessarily to scale, emphasis instead being placed upon illustrating the principles of the invention. Those skilled in the art will understand that the devices and methods specifically described herein and illustrated in the accompanying drawings are non-limiting exemplary embodiments. The features illustrated or described in connection with one exemplary embodiment can be combined with the features of other embodiments. Such modifications and variations are intended to be included within the scope of the present invention.

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
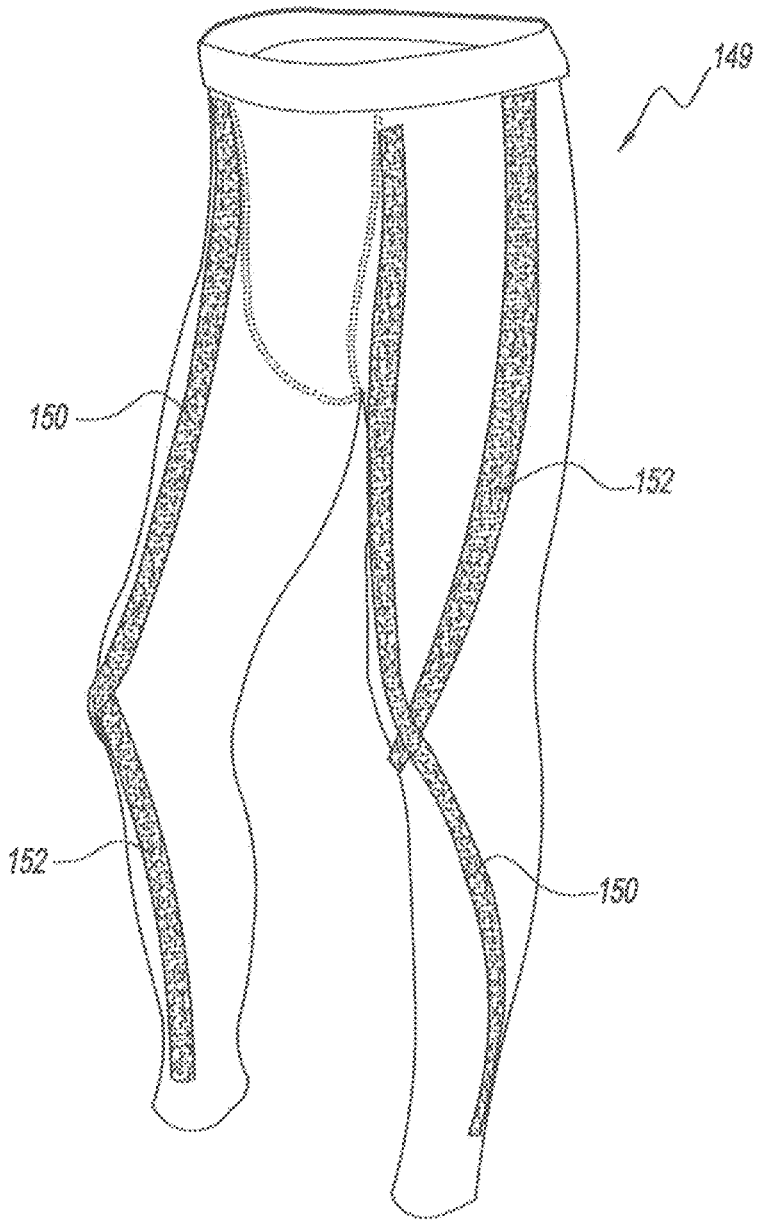
FIG. 1 is a partially schematic view of a first embodiment of pant in accordance with the present invention.

The following is a list of commonly used agonist/antagonist muscle pairs:

pectorals/latissimus dorsi (pecs and lats)
anterior deltoids/posterior deltoids (front and back shoulder)
trapezius 24/deltoids 30 (traps and delts)
abdominals/spinal erectors (abs and lower-back)
left and right external obliques (sides)
quadriceps/hamstrings (quads and hams)
tibialis anterior, extensor digitorum longus 99/gastrocnemius muscles
biceps/triceps
forearm flexors/extensors.

The human body typically utilizes pairs of muscles in which one muscle contracts the other stretches. The return to the previous position is achieved by the initially stretched muscle subsequently being contracted. A goal of embodiments of the resistance wear of the present invention is to replicate the contraction of a muscle, albeit an outside and continuous force thus requiring muscles on the opposing side to engage and ultimately cancel out the resistance wear's force. The purpose is to provide clothing that provides the benefits of resistance training. Such resistance training is often focused on exercise and rehabilitation.

Muscle contraction is the activation of tension-generating sites within muscle fibers. In physiology, muscle contraction does not mean muscle shortening because muscle tension can be produced without changes in muscle length such as holding a heavy book or a dumbbell at the same position. The termination of muscle contraction is followed by muscle relaxation, which is a return of the muscle fibers to their low tension-generating state.

Isotonic contractions generate force by changing the length of the muscle and can be concentric contractions or eccentric contractions. A concentric contraction causes muscles to shorten, thereby generating force. Eccentric contractions cause muscles to elongate in response to a greater opposing force.

Isometric contractions generate force without changing the length of the muscle.

Isotonic contractions are muscular contraction against a resistance in which the length of the muscle changes. The antonym is isometric. Isotonic movements are either concentric (working muscle shortens) or eccentric (working muscle lengthens).

Isometric contractions are muscular contraction against resistance in which the length of the muscle remains the same.

In natural movements that underlie locomotor activity, muscle contractions are multifaceted as they are able to produce changes in length and tension in a time-varying manner. Thus, length and tension are unlikely to remain the same in muscles that contract during locomotor activity.

A goal of the present invention is to have targeted muscles contract eccentrically (the muscle elongates while under tension from an opposing force greater than the muscle produces). Resistance bands place a larger force than the opposing muscles, causing the opposing muscles to lengthen. This then allows the eccentrically contracted muscles to either:

(a) Contract isometrically (forces cancelling each other out, without a change in muscle length) or
(b) Contract concentrically (exert more force than the resistance bands place on them, the muscle shortens in length).

In an isotonic contraction, the muscle length can either shorten to produce a concentric contraction or lengthen to produce an eccentric contraction. Furthermore, if the muscle length shortens, the contraction is concentric. But if the muscle length lengthens, then the contraction is eccentric.

In order to induce continuous tension from the resistance bands:

The resistance bands must be exerting a restoring force back into an equilibrium position; the equilibrium position would experience zero net force, or no tension.

By providing elongated elastic bands having respective equilibrium lengths (without the application of external forces) that are shorter than the distance between two connection points on the clothing, placing the garment on a human body would cause them to stretch to a length greater than the equilibrium length. For convenience of description the term "equilibrium length" is used herein to refer to the length of a given elastic band without the application of external forces. Thus, the elastic bands utilized herein are stretched to a length greater than the equilibrium length, aligned with a specific muscle and secured along the axial extent of one of the muscles of a given pair of muscles and then secured to a garment. Accordingly, the other muscle in the given pair of muscles will be beneficially exercised by the apparatus and method of the present invention.

Antagonist and agonist muscles often occur in pairs, called antagonistic pairs. As one muscle contracts, the other relaxes. An example of an antagonistic pair is the biceps and triceps; to contract—the triceps relaxes while the biceps contracts to lift the arm. "Reverse motions" need antagonistic pairs located disposed on opposite sides of a joint or bone, including abductor-adductor pairs and flexor-extensor pairs. These consist of an extensor muscle, which "opens" the joint (by increasing the angle between the two bones) and a flexor muscle, which does the opposite by decreasing the angle between two bones.

Thus, the concept results in exercise of an agonist muscle in a given pair of muscles by imposing a force on the body that simulates the force and direction that would be produced by the antagonistic muscle if the antagonist muscle was contracted. More particularly, the concept positions an elongated elastic member in aligned proximate relation with respect to the antagonistic muscle in the pair of muscles on a garment worn by the user. Thus, the agonist muscle has to work harder to overcome the forces imposed by the elongated elastic member and improved exercise of the agonist muscle is achieved.

Another aspect to consider is the spring constant (the elasticity of a spring). Hooke's law is a principle of physics that states that the force needed to extend or compress a spring by some distance is proportional to that distance. That is: where is a constant factor characteristic of the spring, its stiffness. By Newton's Third Law of Motion, as a spring is pulled, it pulls back with a restoring force. This force follows Hooke's Law, which relates the force of the spring to the spring constant, and the displacement of the spring from its original position.

How far each resistance bands is stretched will determine the force induced. It will be understood that the elastic bands have an elastic limit whereby after a specific maximum extension the band will not restore to the original length and may break. In order to counteract this issue, elastic bands have varying restoring forces. One band may have greater restoring force and may not be cut as short, thereby resolving the issue of elastic limit. Those skilled in the art will recognize that the force is the product of the elongation times the spring rate for the elastic band. Thus various embodiments provide suitable forces for the particular application and more particularly provide flexibility in choosing how much force will be exerted in opposition to a given muscle.

Various embodiments of the present invention will use elastic bands having different spring rates. More particularly various embodiments of the present invention are constructed with one of three levels of force corresponding to light, moderate, and heavy duty applications. The respective levels in such applications may be achieved by selection of the respective spring rates.

Many muscles are parts of cooperating muscle groups. For example, when muscles cause a limb to move through the joint's range of motion, the motion may be the result of both agonists and antagonists as well synergist and fixator muscles. Synergist muscles perform, or assist in performing, the same set of joint motion as the agonists. Synergists are sometimes referred to as neutralizers because they help cancel out, or neutralize, extra motion from the agonists to make sure that the force generated works within the desired plane of motion. Fixator muscles provide the necessary support to assist in holding the rest of the body in place while the movement occurs. Fixators are also sometimes called stabilizers.

As an example, when you flex your knee, your hamstring contracts, and, to some extent, so does your gastrocnemius (calf) and lower buttocks. Meanwhile, your quadriceps are inhibited (relaxed and lengthened somewhat) so as not to resist the flexion. In this example, the hamstring serves as the agonist, or prime mover; the quadricep serves as the antagonist; and the calf and lower buttocks serve as the synergists. Agonists and antagonists are usually located on opposite sides of the affected joint (like your hamstrings and quadriceps, or your triceps and biceps), while synergists are usually located on the same side of the joint near the agonists. Larger muscles often call upon their smaller neighbors to function as synergists.

Thus, although it is common to think of a joint's movement as being the action of one muscle, multiple muscles may cooperatively function. Each muscle, because of its different attachment points and angle of pull, tends to pull a bone in a different direction. These divergent pulls, collectively, culminate in a certain joint action. A force couple can be defined as a pair of muscle forces that act together on a joint to produce rotation, and these forces may actually exert pulls in opposite directions. These muscles may be synergistic pairs, consisting of prime movers and groups of stabilizers, for instance, or agonist/antagonist pairs. Force couple, then, is actually another way of referring to muscle synergists or a synergistic action.

One example of an important force couple in the human body is the deltoid-rotator cuff force couple. The rotator cuff is more than one muscle but each of these works with the deltoid to create its own important force couple. The major function of this force couple is to prevent migration of the humeral head out of the glenoid socket during shoulder abduction, preventing impingement of the rotator cuff against the acromion. As the deltoid moves the humerus in an upward direction, the pull of the deltoid can exert a shearing force that can pull the humeral head out of its socket in a superior direction, if left unchecked. The rotator cuff muscles each exert a force that checks this tendency, known as the "superior component."

In some cases a force-couple includes agonist, synergist and stabilizer muscles that all work as one (agonist muscles are muscles most responsible for a movement, synergist muscles assist the agonist muscles, and stabilizer muscles support the body while agonist and synergist muscles work)

When a continuous force is applied from outside the body, a motor neuron (a nerve cell forming part of a pathway along which impulses pass from the brain or spinal cord to a muscle or gland) will innervate many different muscle fibers to counter the force. Muscle fibers of adjacent motor units overlap. This interdigitation facilitates several motor units collectively contracting in support of each other rather than working as independent segments.

By targeting a specific area in the body, several muscles will be utilized to react against the resistance wear. The respective placements of the elastic bands are determined by their ability to create movement from a group of muscles. Muscles work by applying forces to parts of bones which are various types of levers.

In some embodiments of the present invention the elastic bands of the resistance clothing, particularly the legs and arms will have band intersection points that replicate the internal structure of muscles and bones.

1. The primary function is to engage muscles throughout the body and act as an outside force, applying constant resistance to opposing muscles.

Through various daily routines and exercises, this increased force will be applied and can also enhance the working out of the body. When a stressor is placed upon the body, a reaction of the kinetic chain increases oxygen and blood supply as well as neural recruitment to a specific area (known as the general adaptation syndrome). Through repetition, the kinetic chain increases the body's proficiency to efficiently supply oxygen and blood as well as effectively employ proper muscle fibers. The human body and mind become efficient at providing the right amount of blood and oxygen to perform functions rather than oversupplying and being wasteful.

2. The second function is to help alleviate poor posture. Poor posture is the result of anyone muscle being over worked against the opposing muscles, and is often job related, e.g. Jobs that require sitting for extended periods of time). There is a stretching or lengthening of one muscle while the opposing muscles tightens. Common examples of poor posture are the shoulders pulled forwards towards the chest and hips that have shifted placing stress loads on the spine. Embodiments of the clothing in accordance with the present invention will help by pulling on the tightened muscles and stretching them back to a normal position or by pulling in the opposite direction causing tightened muscles to engage the resistance and ultimately strengthening them. Strengthening and stretching muscles will improve posture and help reduce stress on the spine.

3. Lastly, this clothing will greatly help in the rehabilitation of the body. Wearing this clothing during rehab places a constant and larger force upon the targeted muscles, reducing the time to fully heal. For example, when a bone is broken and needs to be in a cast for several weeks, the muscles surrounding the bones that are in shortened positions will adapt and undergo a physical shortening themselves. When the cast is removed, the shortened muscles will need to be stretched for weeks in order to regain full mobility. The brain understands where limbs and other body parts are positioned through the use of mechanoreceptors. The cumulative sensory input to the central nervous system from many mechanoreceptors is known as proprioception. This is a vital source of information to the nervous system and studies have shown proprioception to be altered after injury. When proprioception becomes altered, the risk for further injury greatly increases. Injuries noted are low back pain, ankle sprains, and ACL injuries. By focusing on core training and balance, increase their proprioceptive capabilities would result, ultimately enhancing postural control and decreasing tissue overload. By applying a resistance to certain body areas while the clothing is worn, mechanoreceptors receive more information from the body, enhancing proprioception.

The first embodiment of the pant 149 in accordance with the present invention shown in FIG. 1 provides an elastic force intended is to replicate knee flexion (bending of a joint, duplicating quadricep muscles). This is replicated by creating respective pulls from respective bands 150 and 152 that are an outside or external force that is independent of the forces provided by human body muscle forces. This is accomplished by placing a first elastic band 152 in a position that is closed spaced from and aligned with the vastus laterais 89 and vastus medialis 90 muscles. The other band 150 is aligned with and closely spaced to the sortorius muscle path is also replicated and will cause tension on the rotation of the leg. The patella n is the crossing point of the two bands and then continue down the path of the tibialis anterior and extensor digitorum longus 99. The constant pull of the bands 150 and 152 will replicate all of the aforementioned muscles, including the rectus lemons, when flexed. In order to counter these outside forces, the leg must engage muscles in the back of the leg to flex backwards, particularly those of the hamstring complex. Although the full length of the elastic bands 150 and 152 is not visible in FIG. 1 it will be understood that both bands 150 an 152 extend substantially the full length of the axial extent of each leg.

Figure 2:
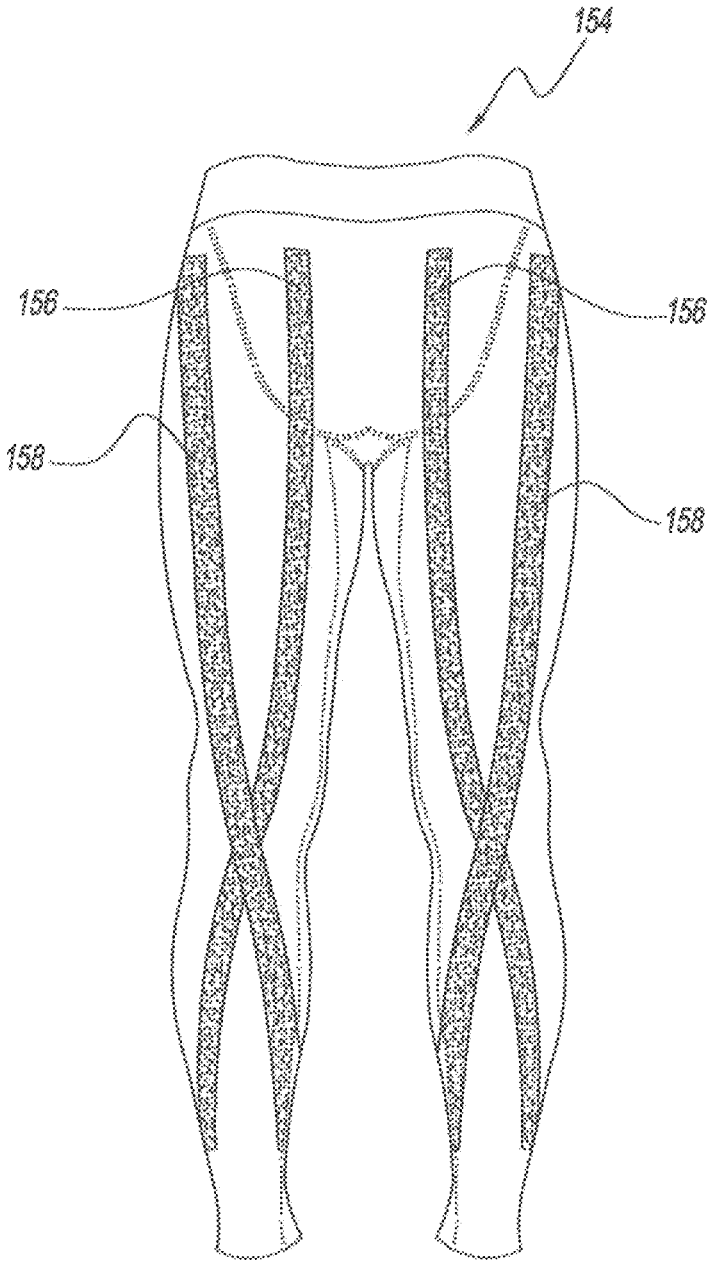
FIG. 2 is a partially schematic view of a second embodiment of pant in accordance with the present invention.

The second illustrated pant 154 embodiment shown in FIG. 2 illustrates elastic bands 158 and 156 located on the back of each leg of the pants. More particularly, the back of the pants have two resistance bands 158 and 156 per leg biasing the respective leg position toward knee flexion (corresponding to the action of the hamstring muscles). The first elastic resistance band 158 follows the path of the biceps femoris 108, while elastic band 156 follows the semitendinosus 109 muscles. The respective resistance bands intersect behind the popliteal fossa and then continue down the back of the calf following the respective medial and lateral gastrocnemius muscles 97. The bands' location outside the body creates a force that causes the leg to bend backwards as if the biceps femoris, semitendinosus, and gastrocnemius muscles are contracted. To counter this force, the muscles in the front of the legs, particularly those of the quadriceps complex will inherently produce a counteracting force.

Figure 3:
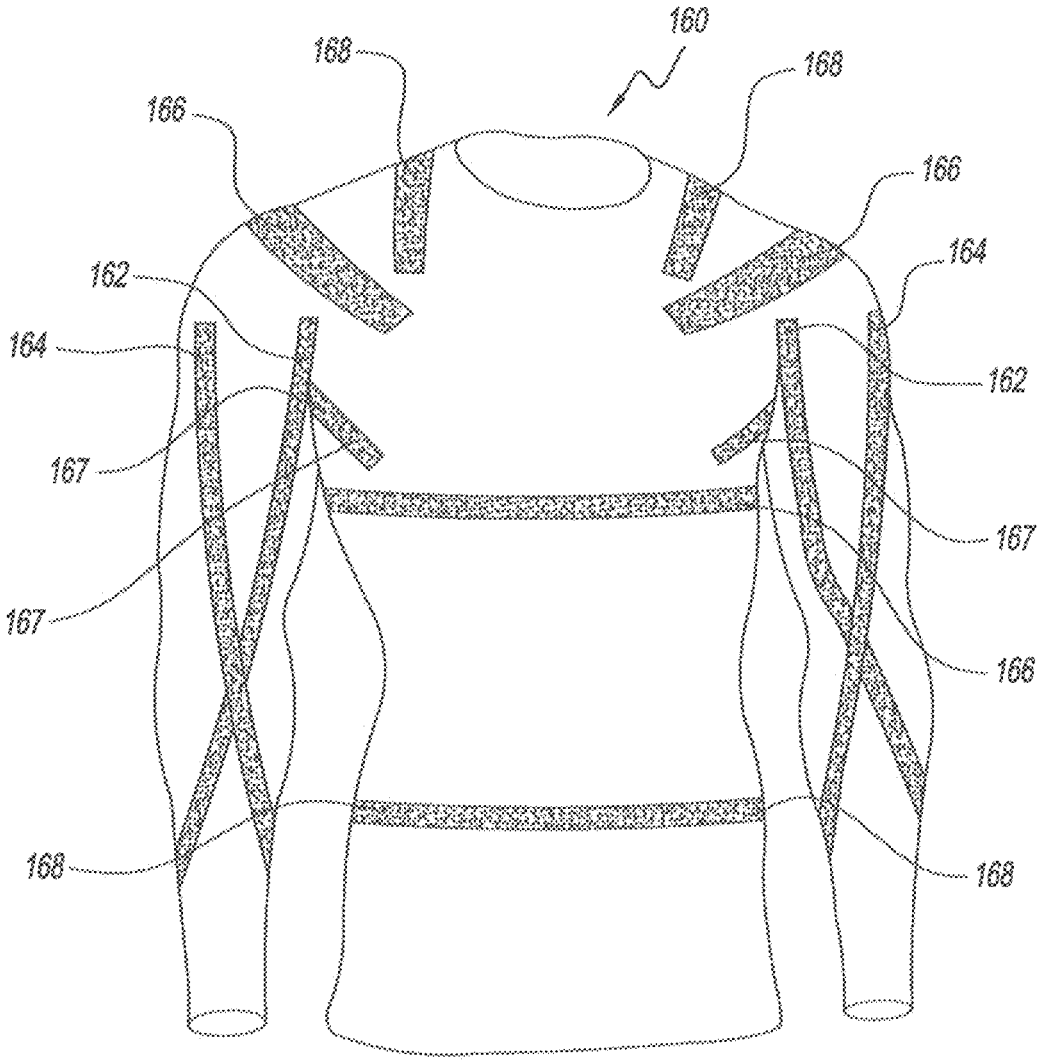
FIG. 3 is a partially schematic front view of a first embodiment of shirt in accordance with the present invention.
Figure 4:
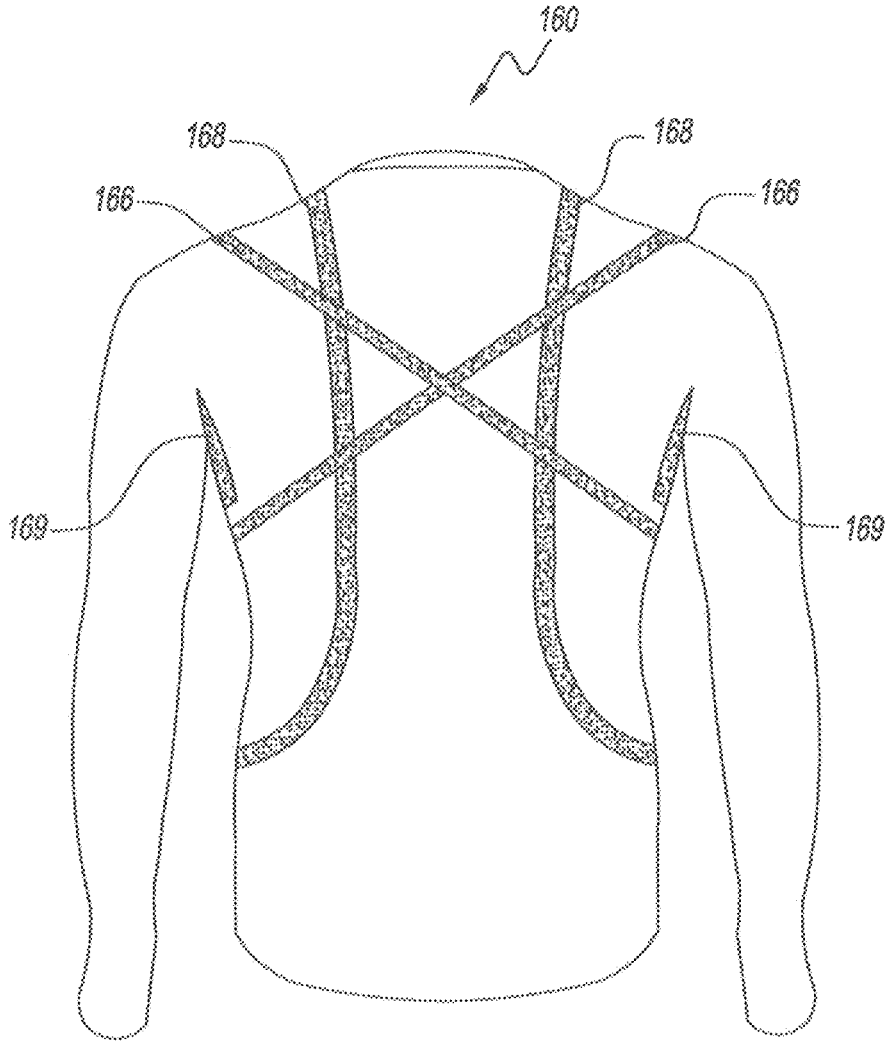
FIG. 4 is a partially schematic rear view of the first embodiment of shirt in accordance with the present invention.

FIGS. 3 and 4 illustrate a first embodiment of a shirt 160 in accordance with the present invention. One part of the shirt will focus on the posterior muscles of the arms, particularly those innervated by the muscu/utaneous nerve. Two bands are placed over the biceps brachii 50. The biceps brachii 50 split into two parts near the top of the arm. One part runs over the intertubercular groove on the humerus and inserts into the supraglenoid tubercle of the scapula. While the second part of the biceps brachii 50 inserts into the caracoid process of the scapula b. The human arm also utilizes the caracoid muscle to act as a flexor of the forearm, a similar performance to the biceps brachii 50. Respective elastic bands 160 are diposed in closely spaced aligned with the biceps brachii 50 for the purpose of innervating posterior muscles on the arms.

The overlapping section of the elastic bands 162 and 164 mimic the insertion of the biceps brachii 50 into the radial tuberosity, while performing the function of this muscle and the caracoid muscle. The pectoralis major 29 is targeted as well. The origin of elastic band 166 is the clavicular head, the medial half of clavicle. By following the path that replicates the position of the infraspinatus muscle 210 illustrated in greater detail in FIG. 12, as well as the middle and inferior fibers of the trapezius 24, we are able to apply a force upon the pectoralis major. The actions of the pectoralis major 29 are shoulder horizontal adduction, shoulder medial rotation, and shoulder adduction.

The elastic band is placed in accordance along the back and through the arms to counteract the function of the pectoralis major 29. This is done so by replicating the posterior deltoid muscle. This muscle is supported by triceps brachii, trapezius 24, and infraspinatus. Deltoids are focused upon in this first illustrated shirt embodiment. Muscles that will be exercised are shoulder abduction (lateral movement of the arms away from the body), horizontal abduction (lateral movement of the arms away from the body from a horizontal position), and flexion (movement of the arm away from the body to the front). This is accomplished by placing two intersecting bands along similar paths of the latissimus dorsi. The intersection of the two bands overlap at the insertion point, which is the intertubercular groove of the humerus. Finally the rectus abdominals will be placed under tension as a single band wraps once around the core, travel up the length of the back, along the sides of the spine, continuing over the shoulders and ending there. The resistance bands will be placed in accordance to the in aligned proximate relationship iliocostalis, longissimu, and spinalis muscles. These muscles work cooperatively to extend the vertebral column. (See bands 167, 168 and 169 in FIGS. 3 and 4.)

Figure 5:
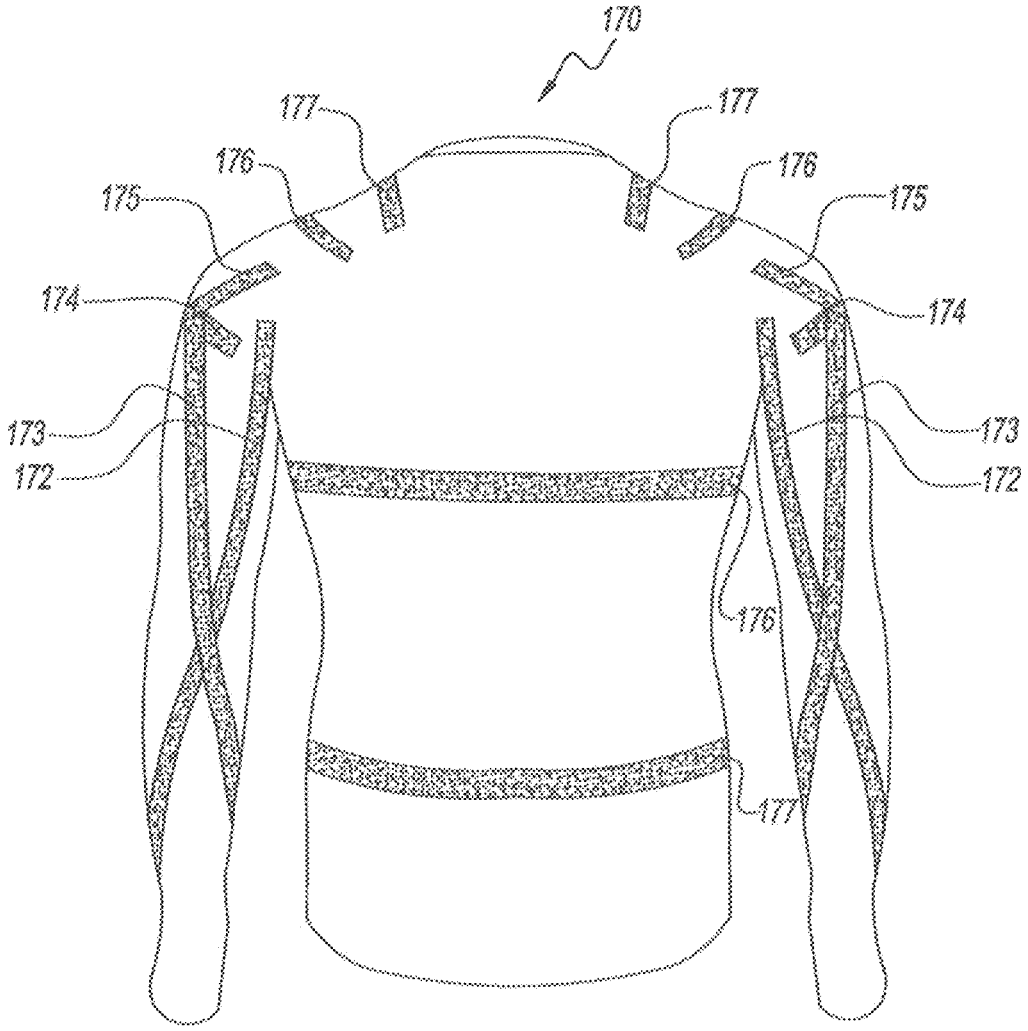
FIG. 5 is a partially schematic rear view of a second embodiment of shirt in accordance with the present invention.
Figure 6:
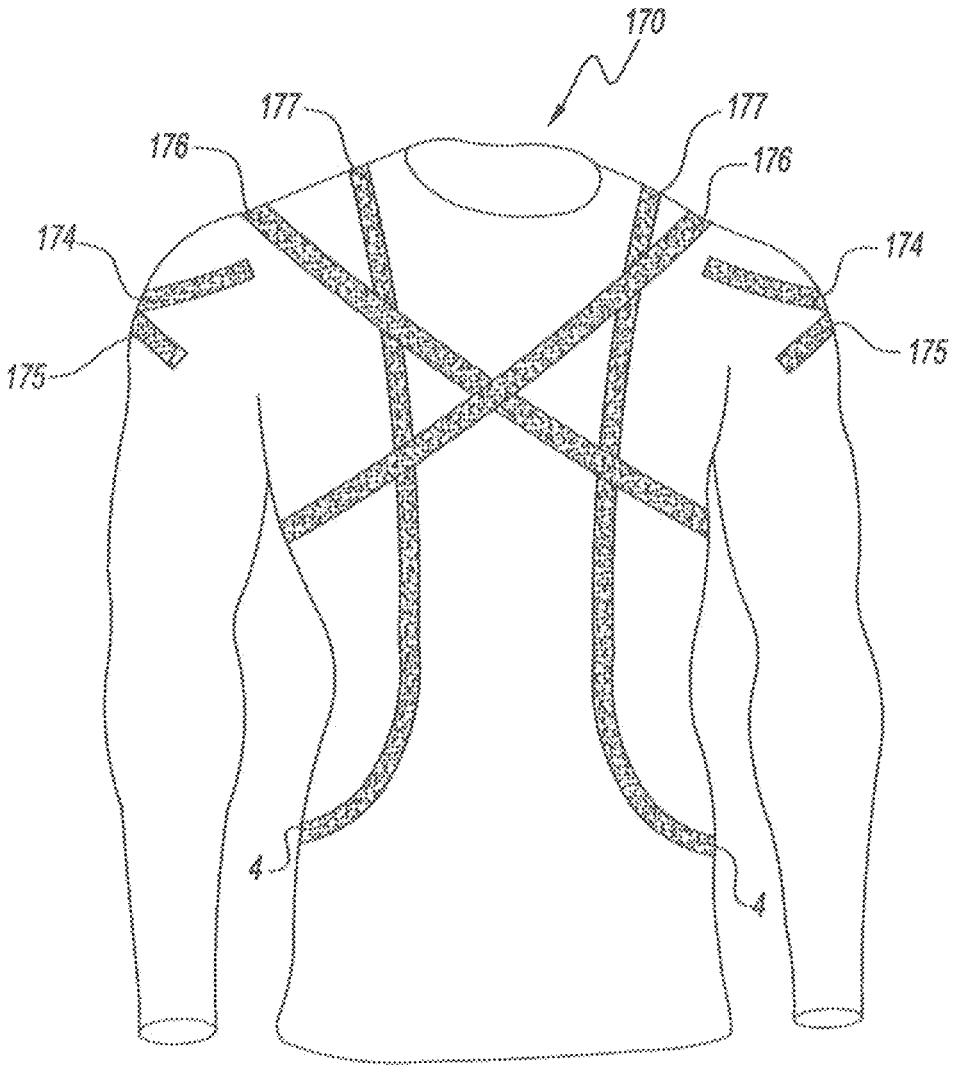
FIG. 6 is a partially schematic front view of a second embodiment of shirt in accordance with the present invention.

A second embodiment of a shirt 170 in accordance with the present invention is shown in FIGS. 5 and 6. This shirt 170 will perform the opposite function of shirt 160. The first area of resistance will focus upon the biceps brachii 50. Elastic bands 172 and 173 are placed following a path similar to the triceps brachii 51 and crossing at the insertion point at the ulna. The anterior and posterior deltoid are the paths for the next resistance bands 174 & 175. Both of these bands 174, 175 intersect at the insertion point of the deltoid into the tuberosity of the humerus. This places tension on the latissimus dorsi muscle. The resistance band 176 follows the path of the pectoralis major 29 and continues looping through the back of the shirt. This replicates flexed pectoralis major muscles 29 and pulls the back and shoulders forward. In order to counter these forces, the upper trapezius 24*a* and rhomboids 45, 46, located between the user's shoulder blades, pull the user's shoulders back while the latissimus dorsi muscles 31 pull the user's upper arms back and into extension. Finally an additional band 177 runs up the front core, over the shoulders and ending near the shoulder blades will resist against the lower back (iliocostalis, longissimu, and spinalis muscles.)

The rectus abdominis muscles 34 and 35 run vertically and help contract the upper body by inserting into the ribs 5-7 and below at the xiphoid process of the sternum. Additional band, 177 follows the path of the rectus abdominis 34 and 35, wrapping the core once and following two paths up the rectus abdominis 34 and 35, over the shoulders and ending at the shoulder blades.

Figure 7:
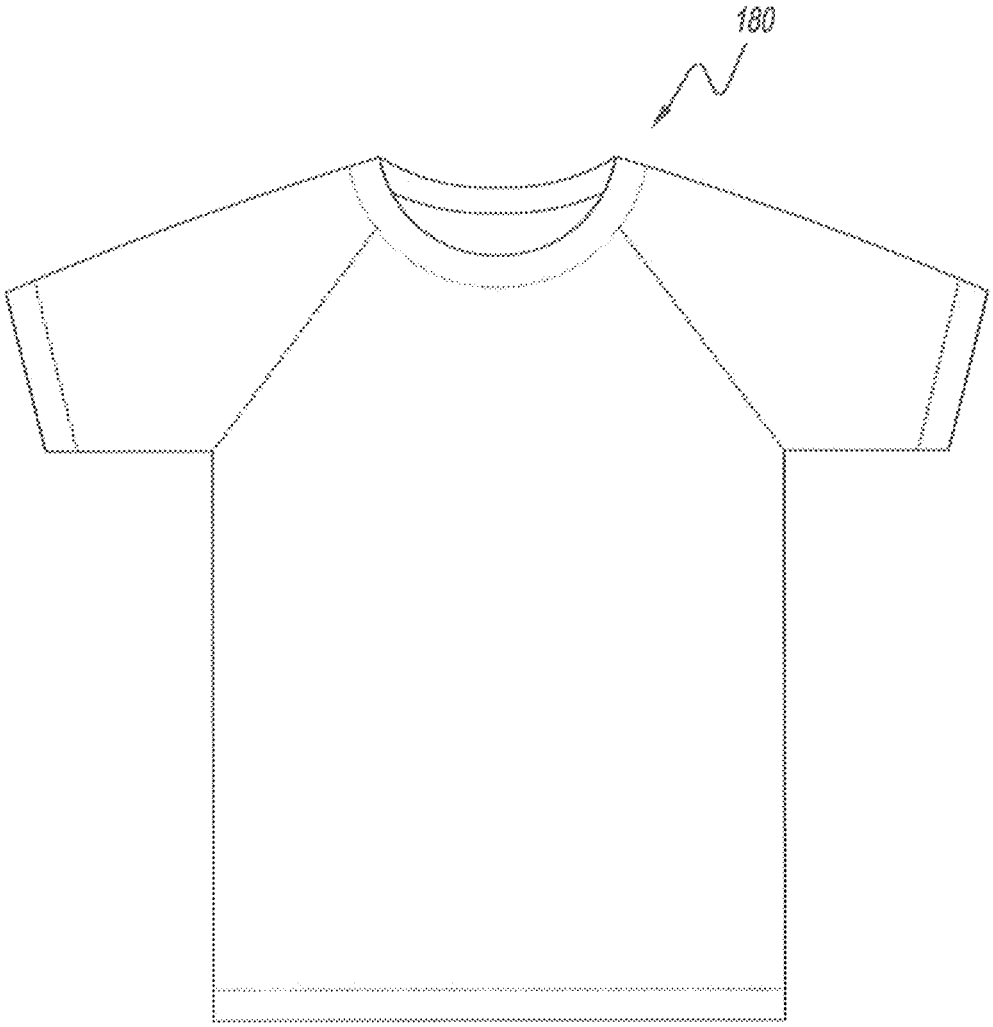
FIG. 7 is a partially schematic front view of a first embodiment of T-shirt in accordance with the present invention.
Figure 8:
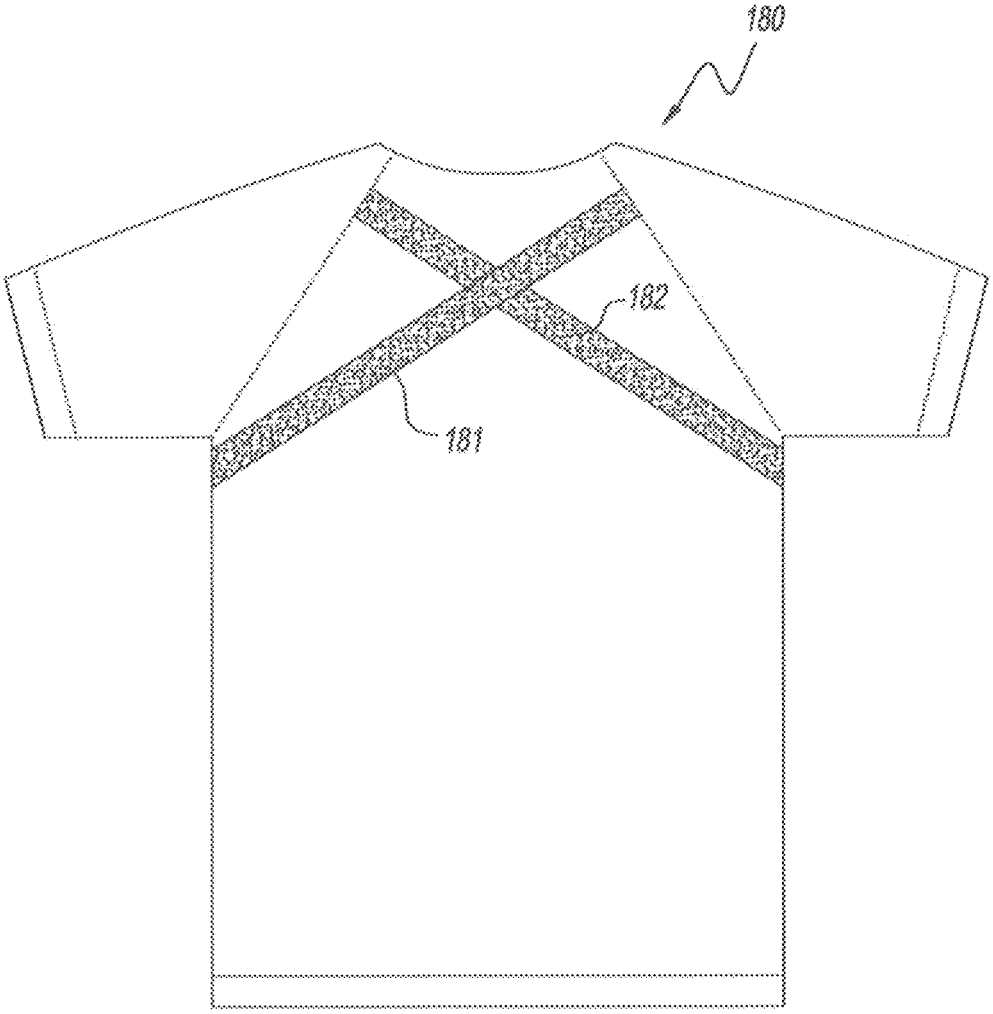
FIG. 8 is a partially schematic rear view of a first embodiment of T-shirt in accordance with the present invention.
Figure 9:
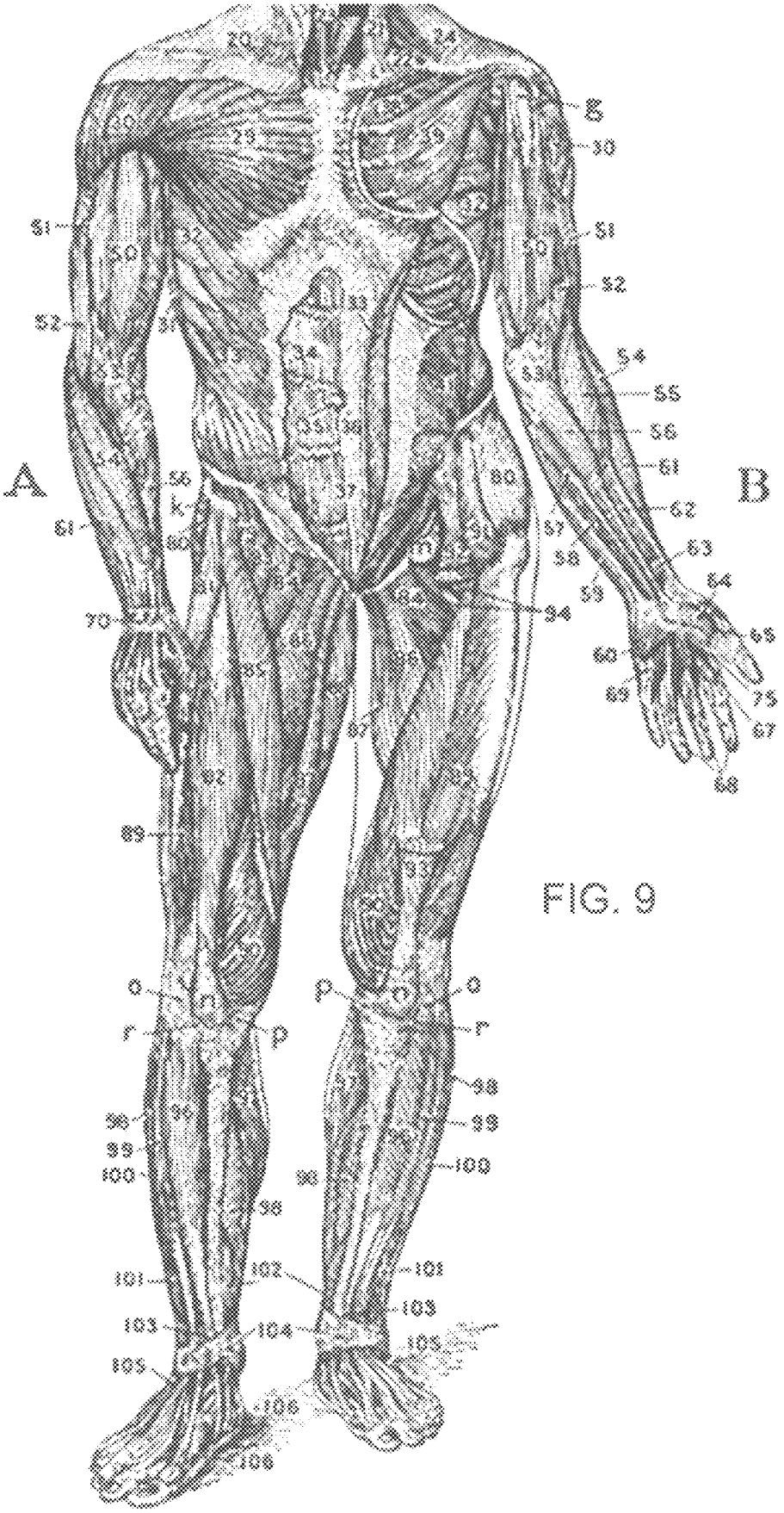
FIG. 9 is a diagrammatic front view of the muscles of a human body.
Figure 10:
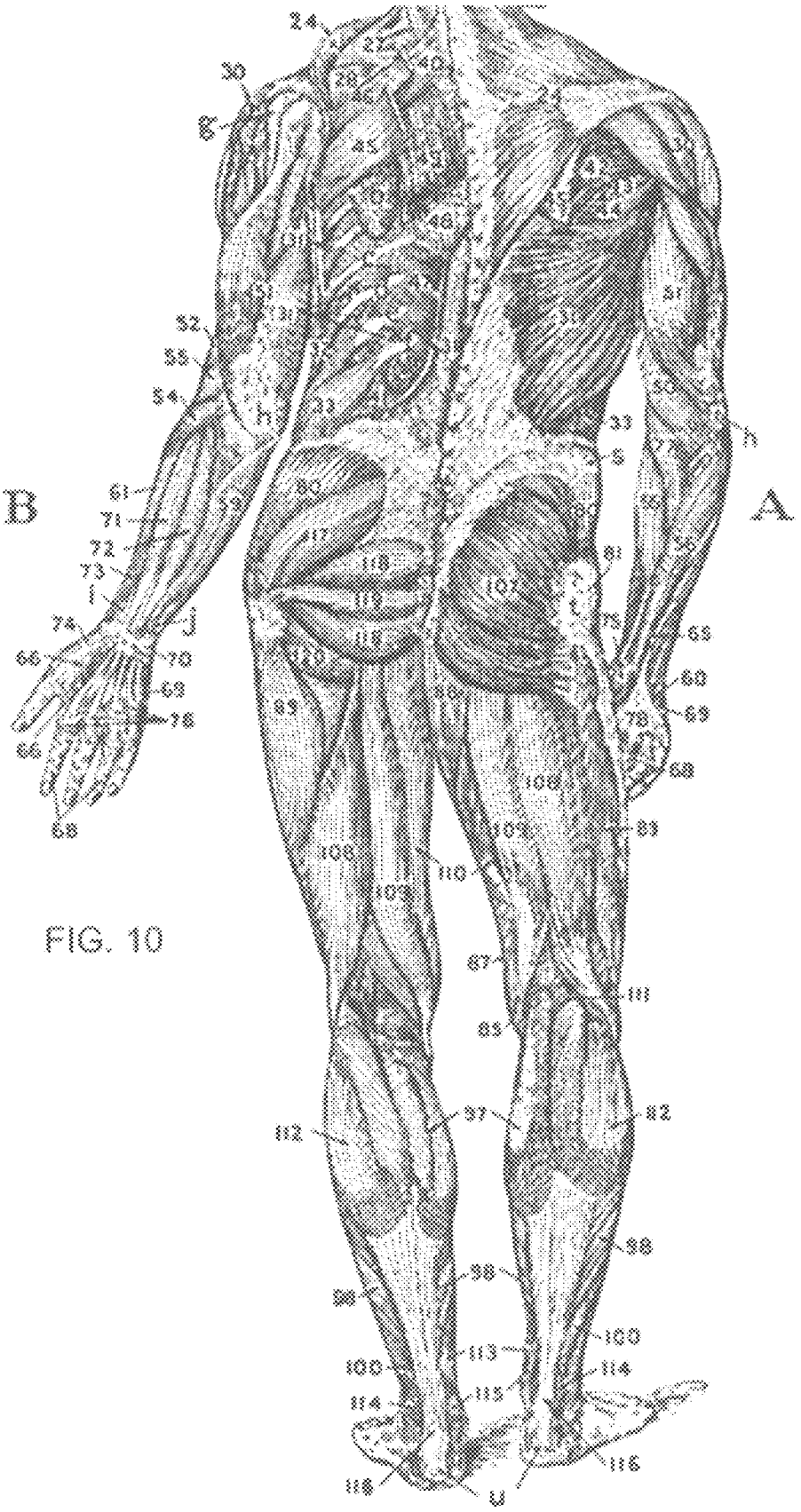
FIG. 10 is a diagrammatic rear view of the muscles of a human body.

Referring now to FIGS. 7 and 8 there is shown a third shirt embodiment of the present invention. This embodiment is a T-shirt 180 having raglan sleeves with flatlock seams. A flatlock is a kind of stitch that sews flat one or two pieces of cloth used for edging, hemming, or seaming. First and second bands are secured to the back into the flatlock seam disposed over the infraspinatus muscle 42, the teres minor muscle 43, posterior deltoid muscle 30, as well as the mid trapezius 24*b* and lower trapezius 24*c* muscles. The benefits with the upper garment shown in FIGS. 9 and 10 is twofold: by placing bands on the opposing side of the pectoralis major 29 muscles, the shirt 180 improves posture and increases the users strength as a result of the positioning of the elastic bands 180 and 182 that provide a substantially continuous tension is being applied. The bands 180 and 182 respectively are aligned and proximate to the anatomical path of the muscles that oppose the pectoralis major 29. These muscles are the infraspinatus muscle 42, the teres minor muscle 43, posterior deltoid muscle 30, as well as the mid trapezius 24*b* and lower trapezius 24*c* muscle.

Figures 11A, 11B:
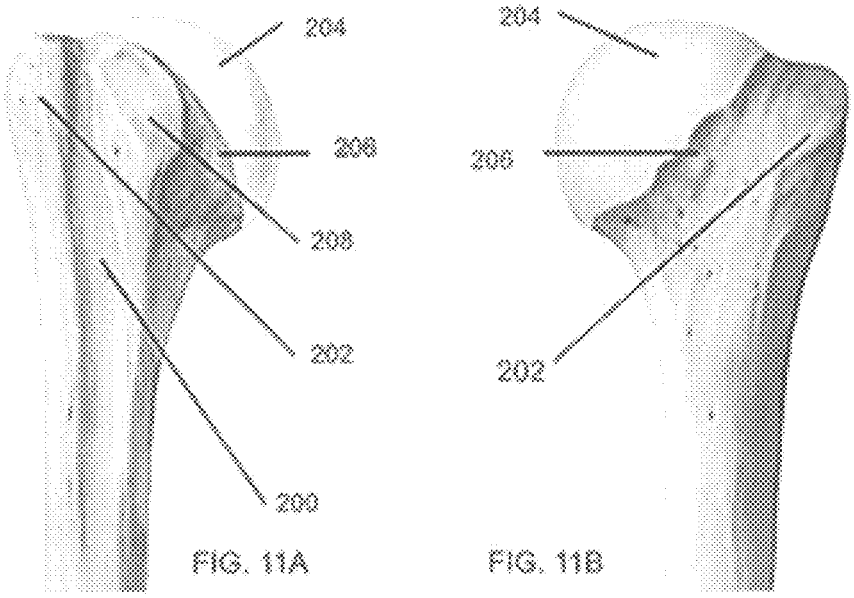
FIGS. 11A and 11B are respectively anterior and posterior diagrammatic views of the humerus bone in the human upper arm.

The shirt 180 includes resistance bands 181 and 182 have respective first ends disposed at respective left and right insertion paths of the muscles at both the intertubercular groove 200 (sulcus) and the crest of the greater tubercle 202. These locations are illustrated in FIGS. 11A and 11B which also illustrates the head of the humerus 204, the anatomical neck 206, and the greater tuberosity 208. The attachment of the resistance bands 180, 182 at this point over the flesh covering the specified insertion points extends the moment arm to the furthest outboard position to create greater torque. (The term "outboard" as used herein refers to a position that is spaced away from vertical central axis of a standing human.) The respective second ends of the bands are on the respective distal sides of the user's torso under the arm pit. Thus, the length is maximized to maximize the torque. This can easily be explained by biomechanics as the muscle insertion themselves are at the furthest most outboard position to minimize the amount of force necessary to rotate a body part. In this manner the apparatus and method of the present invention is able to achieve the greatest amount of torque with the least amount of force applied by a resistance band.

Figure 12:
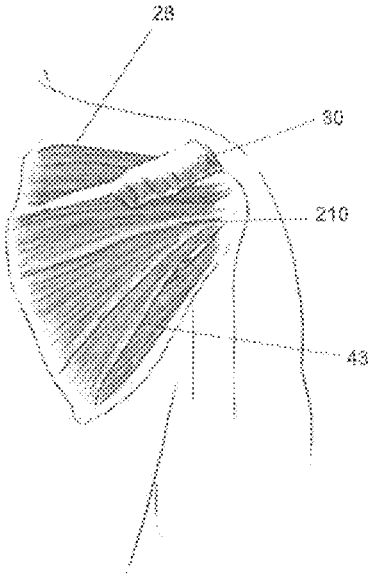
FIG. 12 is a more detailed diagrammatic posterior view of the human right shoulder and the muscles thereof.

Each of the resistance bands 181 and 182 extend from the respective first axial extremities at a downward angle that replicates the position of the infraspinatus muscle 210 illustrated in greater detail in FIG. 12. This infraspinatus muscle 212 is used primarily in the horizontal shoulder abduction. The teres minor muscle 43 as well as the posterior deltoid 30 aid in the horizontal shoulder abduction and follow similar paths. It will be understood that maximizing the torque in the manner described above has the benefit of what might be metaphorically be deemed to be more bang for the buck.

Figure 13:
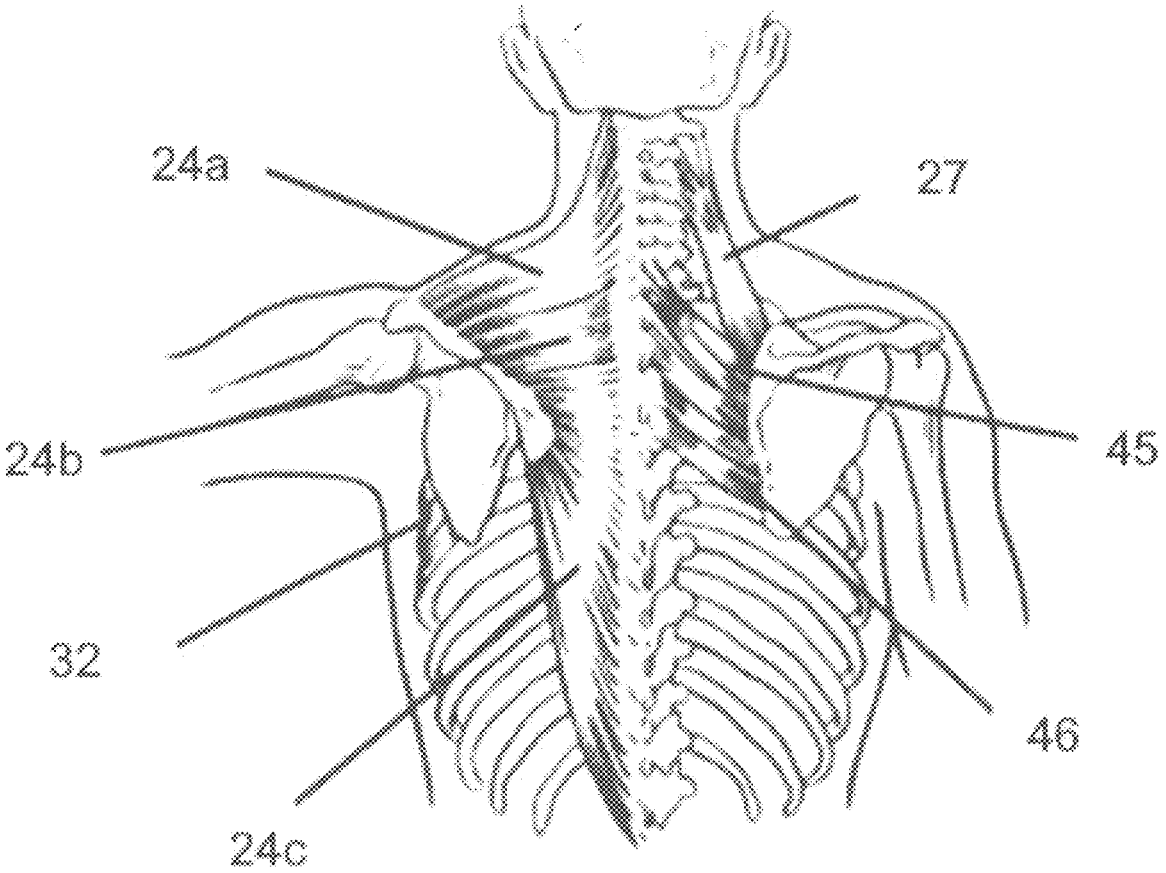

To further this action of horizontal shoulder abduction, the middle and inferior fibers of the trapezius 24 play key roles in promoting proper posture. The location thereof is show in greater detail in FIG. 13 showing the location of both the middle trapezius 24*b* as well as the lower trapezius 24*c*. The insertions for this group of muscles are the spinous process T1-T12, the acromion, the superior lip of spine of the scapula, and lastly the tubercle of the spine. These middle fibers retract the scapulae while the inferior fibers medially rotate and depress the scapulae.

The path of these 3 groups of muscles all follow an oblique path that is substantially at a 45 degree angle with respect to a horizontal or vertical axes of a standing user. The path may also be described as a being disposed at a downward/horizontal angle from their insertion points near the outside of the shoulder down past the spine.

In the illustrated embodiment the resistance bands 181 and 182 extend beyond the spine (which is the center of rotation) to maximize the moment arm. In the embodiment illustrated in FIGS. 7 and 8 the second axial extremity of each elastic band 181 and 182 is secured to the opposite side of the user's torso opposite the bands. This aspect of the present invention is based more on mechanics than anatomy. By extend the moment arm beyond the spine, the present apparatus and method is able to utilize less force (resistance), and yet create the same effect as would be achieved with more robust bands that terminate at the spine.

This construction results in a more comfortable upper garment and makes the manufacturing process easier as short strong bands do not need to be stretched from the insertion points near the shoulder/arm to the spine (on the upper garment) in order to achieve the same results.

In the preferred embodiment the respective elastic bands are latex rubber and in some cases have a width of one inch. The width may however vary based on the spring constant of the band, the muscle involved including the shape and robustness thereof, the size of the garment, the space limitations inherent in the construction of the garment including other elastic bands and the robustness desired for garments in a particular niche markets. The length of the respective elastic bands will ordinarily be at least as long as the muscle over which the respective elastic band is positioned in closely spaced aligned relationship, As described above with respect to the shirt 180 the elastic bands 181, 182 may be longer than the muscle with which the band is disposed in closely spaced aligned relationship.

Typically, each of the respective bands have a length without the application of any external forces that is stretched to a second length that is greater than the first length. When stretched to the second length the band is attached to a garment. Typically the first length is about 60% of the second length.

The location of the respective muscles with which the present invention cooperate will be better understood by reference to FIGS. 9 and 10 which are respective front and back diagrammatic views of human muscles.

Head & Neck Muscles

20. Platysma or Platysma Myoides
21. Sternocleidomastoid
22. Omohyoid
23. Sternohyoid
24. Trapezius
25. Splenius Capitis
26. Splenius Cervicis
27. Levator Scapulae
28. Supraspinatus Trunk Muscles

29. Pectoralis Major
30. Deltoid
31. Latissimus Dorsi
32. Serratus Anterior
33. External Oblique
34. Rectus Abdominis
35. Umbilicus
36. Abdominal Aponeurosis
37. Linea Alba
38. Subclavius
39. Pectoralis Minor
40. Serratus Posterior Superior

41. Internal Oblique
42. Infraspinatus
43. Teres Minor
44. Teres Major
45. Rhomboideus Major
46. Rhomboideus Minor
b. Scapula
c. 9th Rib
d. 10th Rib
e. 11th Rib
f. 12th Rib
47. Serratus Posterior Inferior
48. Lumbodorsal Fascia
49. Sacrospinalis
Upper Extremity Muscles
50. Bicep Brachii
51. Triceps Brachii
52. Branchialis
53. Lacertus Fibrosus
54. Extensor Carpi Radialis Longus
55. Brachiorodialis
56. Flexor Capi Radialis
57. Palmaris Longus
58. Flexor Digitorum Sublimis
59. Flexor Carpi Ulnaris
60. Palmaris Brevis
61. Extensor Carpi Radialis Brevis
62. Flexor Pollicis Longus
63. Pronator Quadratus
64. Flexor Pollicis Brevis
65. Palmaris Longus
66. First Dorsal Interosseus
67. First Lumbricalis
68. Fibrous Sheaths of the Tendons
69. Adductor of the Little Finger
70. Annular Ligament of the Carpus
g. Head of the Humerus
71. Extensor Digitorum Communis
72. Extensor Carpi Ulnaris
73. Extensor Pollicis Longus
h. Medial Epicondyle of Humerus
i. Lower End of Radius
j. Lower End of Ulna
74. Tendons of the Extensors
75. Adductor Pollicis
76. Tendons of the Extensors
77. Pronator Teres
78. Palmar Aponeurosis
Lower Extremity Muscles
k. Anterior Superior Spine of Ilium
79. Iliacus
80. Gluteus Medius
81. Tensor Fasciae Latac
82. Rectus Femoris
83. Psoas Major
84. Pectineus
85. Sartorius
86. Adductor Longus
87. Adductor Mangus
88. Gracilis
89. Vastus Lateralis
90. Vastus Medialis
91. Gluteus Minimus
92. Superior Extremity of Rectus Femoris
93. Inferior Extremity of Rectus Femoris
m. Head of Femur
94. Inferior Extremities of Psoas & Iliacus
95. Adductor Brevis
n. Patella
o. Head of Fibula p. Medial Condyle of Femur Tuberosity of Tibia
96. Tibialis Anterior
97. Gastrocnemius, Medial Head
98. Soleus
99. Extensor Digitorum Longus
100. Peroneus Longus
101. Peroneus Brevis
102. Flexor Digitorum Longus
103. Extensor Hallucis Longus
104. Ligamentum Cruciatum Crusis
105. Extensor Digitorum Brevis
106. Abductor Hallucis s. Iliumt. Greater Trochanter
107. Gleteus Maximus
108. Biceps Femoris
109. Semitendinous
110. Semi membranosus
111. Plantaris
112. Gastrocnemius, Lateral Head
113. Flexor Digitorum Longus
114. Peroneus Tertius
115. Tendon of Tibialis Posterior
116. Achilles Tendon
117. Pyriformis
118. Gemellus Superior & Femellus Inferior
119. Obturator Interous
120. Quadatus Femoris The resistance athletic wear in accordance with the present invention utilizes resistance bands that replicate the muscular system in the human body. Thus, for example, in a agonist and antagonist pair of muscle placing an elongated elastic band in closely spaced aligned relation with one of the muscles in the pair of muscles creates tension upon the other muscles in the pair of muscles. This has particular application to muscles that have connection points to bones to provide flexion. Flexion is the action of bending or the condition of being bent, especially the bending of a limb or joint. As a result the user will feel tension throughout the clothing thereby enhancing exercises, assist in rehabilitation of the body, and improve posture.

Various embodiments of the present invention employ a plurality of elastic bands to achieve the benefits described herein. Those skilled in the art will recognize that other embodiments may use one of more such elastic bands or other elastic bands without departing from the spirit of the present invention.

Although the description herein has been focused on human anatomy it will be understood by those skilled in the art that the apparatus and methods of the present invention has application to other muscles of other animals. For example the apparatus and methods may be used for horses and dogs in competitive races.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

The invention claimed is:

1. A method for fabricating an elastic band-bearing garment, comprising:

a. providing a garment that defines a pair of pants having a first leg, a second leg and a waistband;

b. providing a first elastic band that defines a first end, a second end and a first length extending from the first end to the second end when no external force is applied thereto, c. elongating the first elastic band to a second length that is greater than the first length, d. securing the first end of the first elastic band relative to the garment in a first garment location along a front of the first leg of the pair of pants in proximity to the waistband, and e. securing the second end of the first elastic band relative to the garment in a second garment location along the front of the first leg of the pair of pants;

f. providing a second elongated elastic band that defines a first end of the second elongated elastic band, a second end of the second elongated elastic band, and a first length of the second elongated elastic band extending from the first end of the second elongated elastic band to the second end of the second elongated elastic band when no external force is applied to the second elongated elastic band, g. elongating the second elastic band to a second length of the second elongated elastic band that is greater than the first length of the second elongated elastic band, h. securing the first end of the second elastic band relative to the garment in a third garment location along the front of the first leg of the pair of pants in proximity to the waistband;

i. securing the second end of the second elongated elastic band relative to the garment in a fourth garment location along the front of the first leg of the pair of pants;

j. providing third and fourth elongated elastic bands, and k. securing the third and fourth elongated elastic bands to the pair of pants along the second leg of the pair of pants;

wherein spacing between the first garment location and the second garment location defines a distance that corresponds to the second length of the first elastic band, and whereby the first elastic band is elongated relative to the first length thereof when the garment is worn by an user;

wherein spacing between the third garment location and the fourth garment location defines a distance that corresponds to the second length of the second elongated elastic band, and whereby the second elongated elastic band is elongated relative to the first length of the second elongated elastic band when the garment is worn by an user; and wherein the first and second elongated elastic bands are secured to the pair of pants so as to extend substantially a full length of the first leg of the pair of pants.

2. The method as described in claim 1, wherein the first elastic band and the second elastic band are secured to the garment in a parallel orientation.

3. The method as described in claim 1, wherein the first elastic band and the second elastic band are secured to the garment in a spaced, side-by-side relationship.

4. The method as described in claim 1, wherein the first and second elongated elastic bands cross in a knee region of the pair of pants.

5. The method as described in claim 1, wherein the first elongated elastic band is fabricated from a latex rubber.

6. The method as described in claim 1, wherein the first length is about sixty percent (60%) of the second length.

* * * * *